US005917389A

United States Patent [19]

Moeller et al.

[11] Patent Number: 5,917,389

[45] Date of Patent: Jun. 29, 1999

[54] MONOLITHIC DIELECTRIC MICROWAVE WINDOW WITH DISTRIBUTED COOLING

[75] Inventors: Charles Porter Moeller, Del Mar; Hiroyuki Ikezi, Rancho Santa Fe, both of Calif.

[73] Assignee: General Atomics, San Diego, Calif.

[21] Appl. No.: 08/895,323

[22] Filed: Jul. 16, 1997

[51] Int. Cl.[6] ..... H01P 1/08

[52] U.S. Cl. ..... 333/252; 333/239

[58] Field of Search ..... 333/239, 248, 333/252; 343/753

[56] References Cited

U.S. PATENT DOCUMENTS

| | | | |
|---|---|---|---|
| 3,416,065 | 12/1968 | Redfern . | |
| 3,723,900 | 3/1973 | Johnson . | |
| 4,453,139 | 6/1984 | Labaar . | |
| 4,688,004 | 8/1987 | Hirai et al. . | |
| 5,051,715 | 9/1991 | Agosti et al. | 333/252 |
| 5,313,179 | 5/1994 | Moeller . | |
| 5,400,004 | 3/1995 | Moeller | 333/252 |
| 5,548,257 | 8/1996 | Caplan et al. . | |
| 5,729,239 | 3/1998 | Rao | 343/753 |

*Primary Examiner*—Paul Gensler
*Attorney, Agent, or Firm*—Nydegger & Associates

[57] ABSTRACT

A microwave window is made as a flat layer of dielectric material having opposite first and second surfaces. Between these surfaces, the window is formed with a plurality of parallel coolant channels which, in cross-section, have race-track configurations with flat sides and curved ends. The channels are distanced from each other in the window to establish parallel plate waveguides between the flat sides of adjacent channels. A plurality of cylindrical lenses are formed on the first surface of the dielectric layer to focus incident microwaves into convergence in a respective waveguide. Additionally, a plurality of cylindrical lenses are formed on the second surface of the dielectric layer to refocus microwaves emerging from the parallel plate waveguides back into a substantially parallel relationship as the microwaves radiate from the window.

15 Claims, 2 Drawing Sheets

MONOLITHIC DIELECTRIC MICROWAVE WINDOW WITH DISTRIBUTED COOLING

FIELD OF THE INVENTION

The present invention pertains generally to microwave windows which include coolant channels that prevent excessive heating of the window during the transmission of microwaves through the window. More particularly, the present invention pertains to the structure of a dielectric material which is used as a microwave window that directs microwaves away from the coolant channels in the window and confines them to predetermined routes through the dielectric. The present invention is particularly, but not exclusively, useful for directing microwave energy from a gyrotron to a device for magnetically confining a plasma for controlled thermonuclear fusion or to a sintering chamber.

BACKGROUND OF THE INVENTION

Very high-frequency power generators, such as gyrotrons, which are used for microwave heating, are often operationally coupled with other devices such as a plasma confinement chamber or a sintering chamber. Not infrequently, it happens that the microwave power generator and the device to which it is coupled operate in totally different pressure environments. Typically, as is the case for a gyrotron, the microwave power generator operates in extremely low partial vacuums. On the other hand, the device to which generator is coupled may preferably operate at several atmospheres of pressure. Under such circumstances it is necessary that a pressure (vacuum) barrier be erected between the two. Such barriers are normally referred to as microwave windows.

An important consideration for a microwave window is that, in addition to establishing an effective pressure (vacuum) barrier, it efficiently and effectively allows the transit of microwaves through the window. For this purpose, it is widely known that dielectric materials are preferred. It is also known that, although some dielectric materials are superior to others for transmitting microwaves, even the better dielectric materials exhibit some dielectric losses. Importantly, these dielectric losses include the generation of heat which needs to be effectively dissipated.

One solution for removing heat from a microwave window is to form the window with interior coolant channels which will carry heat from the window during its operation. Several examples of structures for microwave windows which incorporate coolant channels, can be cited. For example, U.S. Pat. No. 5,313,179 which issued to Moeller for an invention entitled "Distributed Window for Large Diameter Waveguides", and which is assigned to the same assignee as the present invention, discloses a vacuum barrier with alternating dielectric and hollow metallic strips. As disclosed by Moeller, a suitable coolant is caused to flow through the metallic strips to cool the barrier. As another example, U.S. Pat. No. 5,548,257 which issued to Caplan et al. for an invention entitled "Vacuum-Barrier Window for Wide-Bandwidth High-Power Microwave Transmission" discloses a device which incorporates liquid-coolant conduits for the purpose of removing heat from the window.

Several competing concerns arise when coolant channels are incorporated into a microwave window. One consideration is that the coolant channels in the microwave window introduces a periodicity which will affect the transmission of microwaves through the window. Unless properly accounted for, this periodicity can cause unacceptable alterations of the wave structure. Further, it is important for the coolant channels to be properly positioned in order to affect the most efficient cooling of the dielectric material in the window. Also, it is necessary that as much power as possible be transmitted through the window. Still further, the structural strength and integrity is affected by the coolant channels.

In light of the above it is an object of the present invention to provide a structural configuration for a microwave window which can be dimensionally designed with an arbitrary thickness to withstand increased pressure differentials across the window, and dimensionally designed with an arbitrary width to accommodate larger microwave power. It is another object of the present invention to provide a microwave window which efficiently removes heat from the window during the passage of microwaves through the window. Still another object of the present invention is to provide a microwave window which minimizes the power that is absorbed by the window during the passage of microwaves through the window. Yet another object of the present invention is to provide a microwave window design which, by tilting the window, allows the window to be scaled for higher frequencies without the need to reduce dimensions of the most difficult to fabricate features. Another object of the present invention is to provide a microwave window which reconstitutes the radiated wave into substantially the same wave structure as that of the incident wave. Another object of the present invention is to provide a microwave window which is easy to use, relatively simple to manufacture and comparatively cost effective.

SUMMARY OF THE PREFERRED EMBODIMENTS

A microwave window in accordance with the present invention includes a layer of dielectric material, such as silicon nitride ($Si_3N_4$). The layer has a first surface and an opposed second surface, and is formed with a plurality of internal coolant channels which are mutually parallel and are located between the first and second surfaces. Further, the first and second surfaces of the dielectric layer are both formed with a plurality of contiguous cylindrical shaped lenses. Specifically, the lenses are arranged parallel to each other, and are located on their respective surface to focus their respective focal lines into the regions between adjacent coolant channels inside the layer of dielectric material.

For the present invention, each coolant channel has a cross-section which is configured substantially like a racetrack. Specifically, each coolant channel has opposed flat parallel sides, and opposed ends which are curved in a half circle. Further, all coolant channels in the microwave window are juxtaposed to at least one other coolant channel, and the flat sides of each coolant channel are mutually parallel with the flat sides of all other coolant channels. With this structure, whenever the coolant channels are filled with a metallic liquid, as is intended for the present invention, the coolant channels establish parallel plate waveguides. More specifically, these waveguides constitute the region between juxtaposed channels.

For the structure of the present invention, a comparison of particular structural dimensions for the microwave window relative to the free space wavelength ($\lambda_o$) of the microwave that is passing through the window is instructive. These dimensions are: a) the distance between centers of adjacent coolant channels (P); b) the height (D) to which the lenses extend from the window; and c) variations in waveguide length (S). First, in keeping with conventional practices, the distance between centers of adjacent coolant channels (P) is to be less than the free space wavelength (i.e. $P<\lambda_o$). Second, the peak distance (D) to which all of the cylindrical lenses rise from their respective surface of the layer is less than approximately one fourth of the free space wavelength ($D<\lambda_o/4$). Finally, the length of the waveguide (S) established between adjacent cooling channels (this is actually the distance between the ends of the cooling channels) can be incrementally changed if proper account is taken of the free space wavelength ($\lambda_o$) and the dielectric constant of the layer ($\in$), namely $\Delta S=n\lambda/2\sqrt{\in}$.

Due to the structure of the microwave window of the present invention, and in particular the structure of the parallel plate waveguides between the coolant channels, it is possible to scale the window for higher frequencies. This can be done in part by tilting the window through an angle $\phi$ relative to the incident microwave. Importantly, this is accomplished with minimum reduction of the width of the waveguides as measured between the coolant channels.

In the manufacture of a microwave window in accordance with the present invention, a first stratum and a second stratum of dielectric material are initially selected and an inner surface and an outer surface are identified for each. Next, a plurality of parallel grooves are ground on the inner surface of each stratum. The inner surfaces of the two strata are then joined together to overlie respective grooves and, thus, form the plurality of coolant channels. Preferably, the strata are then fusion bonded together to create a layer of dielectric material with internal coolant channels. As indicated above, when a metallic liquid coolant is introduced into the coolant channels, the region between coolant channels is effectively established as a parallel plate waveguide. Next, the exposed outer surfaces of the stratum are ground to form a plurality of contiguous parallel cylindrical lenses. Specifically, these lenses are positioned on the surfaces so that they focus incident microwaves onto a focal line in a respective waveguide, and refocus microwaves emerging from the waveguide to reform the microwave structure after transition through the dielectric material of the microwave window.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DESCRIPTION OF THE PREFERRED EMBODIMENT

Figure 1:
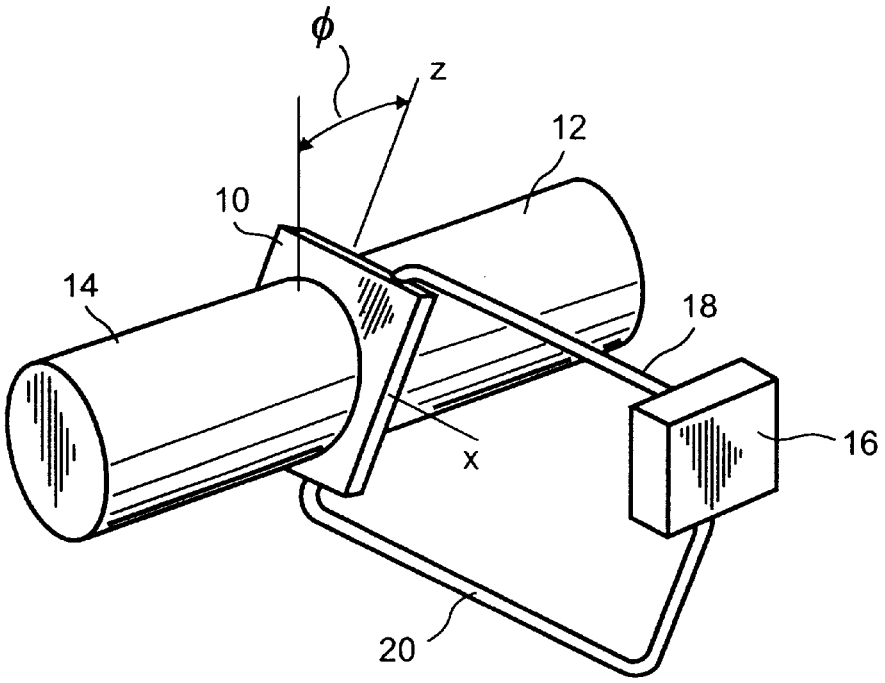
FIG. 1 is a schematic of a microwave window in accordance with the present invention shown in its intended operational environment.

Referring initially to FIG. 1, a microwave window in accordance with the present invention is shown in its intended operational environment and is designated 10. In this operational environment, the window 10 is used as a pressure (vacuum) barrier to isolate an input waveguide 12 from an output waveguide 14. Such a barrier is required often due to the operating pressure differential between the waveguides 12 and 14 and for protection of the equipment in the event there is a fault or accident. For example, the input waveguide 12 may be coupled to a gyrotron (not shown) which typically operates with a partial vacuum. The output waveguide 14, at the same time, may be coupled to a plasma confinement chamber which will operate at relatively higher pressures. Indeed, it is conceivable that pressure differentials as great as ten atmosphere may be encountered across the microwave window during fault conditions. For purposes of the present invention, the window 10 is made from a dielectric material which is, preferably, silicon nitride ($Si_3N_4$). It is to be appreciated, however, that other dielectric materials may also be used, such as alumina, or its crystalline form, sapphire. Diamond could also be used.

FIG. 1 also shows that the window 10 is connected to a coolant unit 16 via both a coolant input line 18 and a coolant discharge line 20. For the present invention, the coolant unit 16 will include a pump (not shown) and heat radiation means (also not shown). With this arrangement, coolant unit 16 will pump coolant to the window 10 via the input line 18. Heated coolant will then be received from the window 10 via the discharge line 20. The heated coolant is then passed through the heat radiation means of coolant unit 16 to cool the coolant before it is again pumped to the window 10. Preferably, the coolant used to cool window 10 is a metallic liquid, such as sodium, indium or gallium. When using a metallic coolant it will be appreciated that the pump of coolant unit 16 may be a direct magnetic drive type pump.

Figure 2:
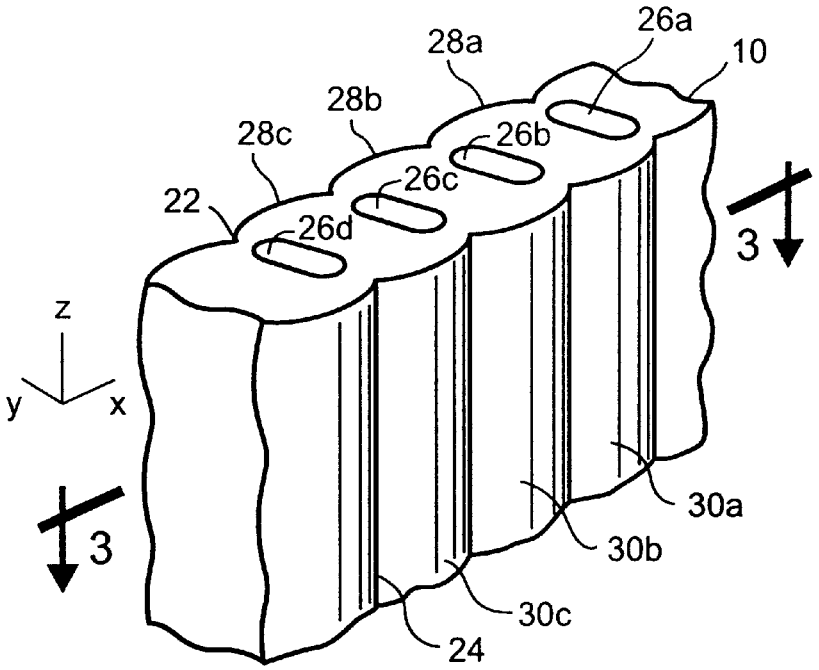
FIG. 2 is a perspective view of a portion of the microwave window.

The actual structure of window 10 will, perhaps, be best appreciated by reference to FIG. 2 wherein it will be seen that the window 10 essentially comprises a layer of dielectric material that has opposed surfaces 22 and 24. As shown, a plurality of coolant channels 26 are formed into the window 10, of which the coolant channels 26 *a–d* are representative. Specifically, the coolant channels 26 are located intermediate between the surfaces 22 and 24 of window 10, and they are substantially parallel to each other. Further, the coolant channels 26 are elongated to extend entirely through the window 10. Thus, each coolant channel 26 defines a longitudinal axis which lies substantially in the x-z plane, as indicated in the orthogonal x-y-z reference system accompanying FIG. 2.

FIG. 2 also shows that the surface 22 of window 10 is formed with a plurality of contiguous lenses 28, of which the lenses 28 *a–c* are representative. Similarly, the surface 24 of window 10 is formed with a plurality of contiguous lenses 30, of which the lenses 30 *a–c* are representative. More specifically, the lenses 28 and 30 are cylindrical lenses. At least the lenses 28 and 30 are cylindrical in the sense they are elongated and extend across the respective surfaces 22 and 24. Preferably, the lenses 28 and 30 are substantially circular in configuration, however, other configurations are possible. In order to appreciate the dimensional and cooperative relationships between the coolant channels 26 inside the window 10, and the lenses 28 and 30 on the respective surfaces 22 and 24 of the window 10, reference is made to FIG. 3.

Figure 3:
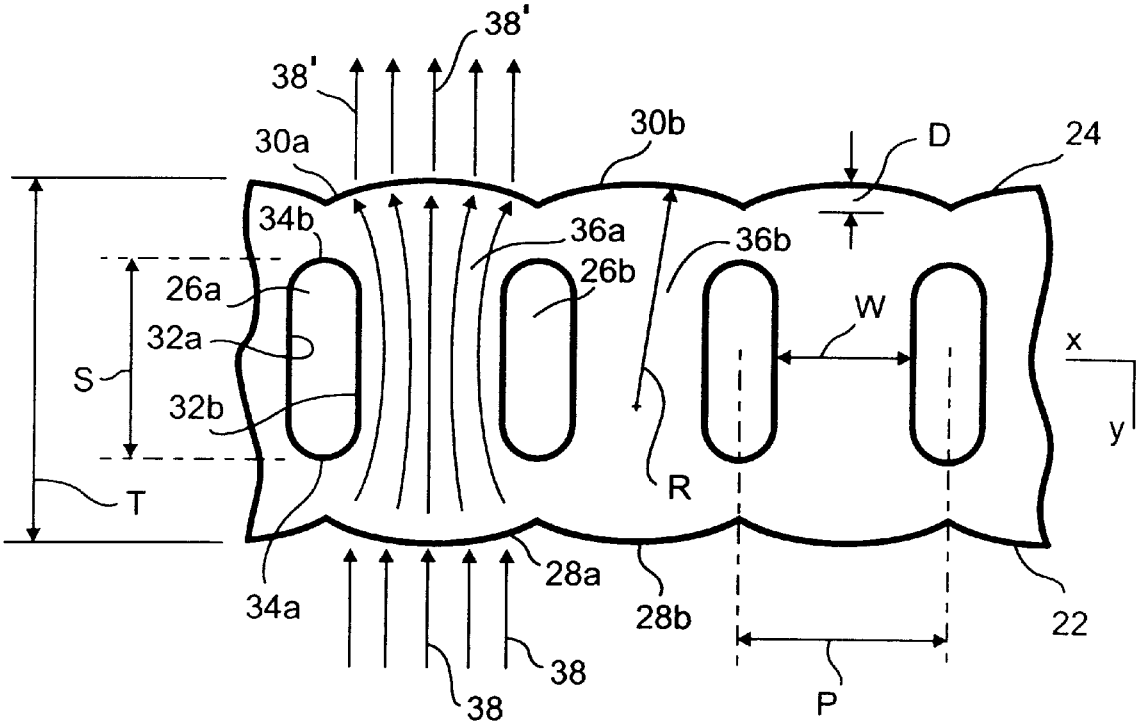
FIG. 3 is a cross-sectional view of a portion of the microwave window as seen along the line 3—3 in FIG. 2.

In FIG. 3 it will be seen that several dimensions for the window 10 are important. One such dimension, the period distance between centers of adjacent coolant channels 26, is designated P. This is a particularly important dimension in that P is constrained by the free space wavelength, $\lambda_o$, of the microwave which is transiting the window 10. Specifically, in order to insure that the periodic nature of the window 10 does not scatter incident microwave radiation into directions different from the direction of the incident radiation, the period distance, P, needs to be less than the free space wavelength (i.e. $P<\lambda_o$). Other dimensions of the window 10 can also be discussed in terms of the free space wavelength, $\lambda_o$. For instance, the height, D, which defines the variations that lenses 28 and 30 impose on the respective surfaces 22, and 24 will generally be less than approximately one quarter of the free space wavelength ($D<\lambda_o/4$). Of course, D is directly related to the radius of curvature R for the lenses 28 and 30 when they are cylindrical circular lenses. It should be noted that the center radius of the arc of R will not necessarily be centered midway between the surfaces 22 and 24. Instead, R may be generally chosen as desired for the particular design and intended use of the window 10.

An important aspect of the present invention stems from the configuration of the coolant channels 26. As shown in FIG. 3, all of the coolant channels 26 have a cross-section which is generally configured as a racetrack. For example, consider coolant channel 26*a*. The coolant channel 26*a* has opposed substantially flat sides 32*a* and 32*b*. It also has semicircular ends 34*a* and 34*b* which complete the racetrack configuration. As indicated earlier, the coolant channels 26 extend completely through the window 10. In the x-y plane of window 10 shown in FIG. 3, each of the coolant channels 26 has a length, S, and the distance between adjacent coolant channels is designated, W.

Importantly, all of the coolant channels 26 are substantially similar to the configuration disclosed above for coolant channel 26*a*. Further, as indicated in FIGS. 2 and 3, the various coolant channels 26 which are formed into the window 10 are oriented with their respective flat sides 32 mutually parallel to each other. Accordingly, a parallel plate waveguide 36 can be established between adjacent coolant channels when the channels are filled with a liquid metal or a dielectric fluid having a dielectric constant $\in$ much less than the dielectric constant $\in$ of the window material. For instance, the parallel plate waveguide 36*a* is established between the flat sides 32 of adjacent coolant channels 26*a* and 26*b*. The parallel plate waveguide 36*b* is then established between the flat sides 32 of adjacent coolant channels 26*b* and 26*c*. Additional waveguides 36 are established in a similar way between other coolant channels 26, and so on.

Insofar as the parallel plate waveguides 36 are concerned, the distance W between adjacent waveguides 36 can be varied somewhat within the constraint $P<\lambda_o$. Also, the respective lengths of the coolant channels 26, designated S in FIG. 3, can be varied. Specifically, the length S of the waveguides 36 which is effectively the distance between the ends 34*a,b* of the cooling channels 26 can be incrementally changed if proper account is taken of the free space wavelength ($\lambda_o$) and the dielectric constant of the layer ($\in$), namely $\Delta S=n\lambda/2\sqrt{\in}$. In fact, as a design consideration, it may be desirable to increase the strength of the window 10 by extending the dimension S. In any event, it is important that the dimensions T and S be chosen so that the dielectric material in window 10 is kept as close as possible to the coolant channels 26 so that maximum cooling efficiency is maintained. An example of typical dimensions used for a window 10 which is to transmit a 110 GHz microwave would be as follows: P=0.100 inches (2.54 mm); W=0.060 inches (1.524 mm); D=0.040 inches (1.016 mm); T=0.140 inches (3.56 mm); and S=0.066 inches (1.676 mm).

In the operation of the window 10 of the present invention, a microwave will be incident on a surface of the window 10. In FIG. 3, such a microwave is represented by the beams 38 which are shown incident on the cylindrical lens 28*a* that has been formed into the surface 22 of window 10. The lens 28*a* then focuses the beams 38 into convergence inside the window 10 for passage through the parallel plate waveguide 36*a*. Recall, it is preferable that the coolant channels 26 be filled with a liquid metal coolant in order for adjacent coolant channels 26 to effectively establish parallel plate waveguides 36. Then, as the beams 38 emerge from the parallel plate waveguide 36*a*, the cylindrical lens 30*a* that is formed into the surface 24 of window 10 will refocus the emergent beams 38'. Specifically the beams 38' are refocussed such that they are reconstructed into substantially the same wave structure as that of the incident beams 38.

Regarding polarization of the incident wave, waves having the electric field in the y-z plane, referring to FIG. 2, or perpendicular to the y-z plane, can both propagate through this window, however, the electric field in the y-z plane is preferred if $\lambda_o/(2w\sqrt{\in})<5/8$, approximately, because any further reduction of $\lambda_o/w$ beyond that value causes the ohmic losses on the liquid metal to fall far more rapidly than with the other polarization.

Returning to FIG. 1 it will be appreciated there are alternative orientations for the window 10. Specifically, in FIG. 1 it will be seen that the window 10 can be tilted through an angle $\phi$ which is measured in the y-z plane. In relationship to the window 10, the y-z plane can be defined relative to the x-z plane which is shown to lie within the layer of window 10. In general, the x-z plane can be used as a reference plane and is defined by the longitudinal axes of the coolant channels. The y-z plane is then a measurement plane and can be defined as a plane which is perpendicular to the x-z plane and which can include a longitudinal axis of a coolant channel 26. Within this framework, the window 10 can be tilted through an angle $\phi$ and still avoid the creation of unwanted side lobes so long as the relationship, $P<\lambda_o/\cos\phi$, is satisfied. In an extreme case, the angle $\phi$ can be taken as Brewster's angle, which is defined mathematically as $\tan\phi=\sqrt{(\in_o\&\in)}$, where $\in_o$ and $\in$ are the dielectric constants of the medium which the microwaves pass through as they impinge on the window 10 and the window 10, respectively, in which case there will be no reflections of the microwave within the window 10. Dielectric losses per unit volume in this case would be minimized.

When tilted at an angle $\phi$, the free space wave vector $\underline{k}_o$, where $\underline{k}_o=|\underline{k}_o|=2\pi/\lambda_o$ of the incident plane wave, has a projection $\underline{k}_z=\underline{k}_o\sin\phi$, along the z axis. As shown in FIG. 2, the z axis is the axis along which the structure of window 10 is uniform in cross section. Also, there is a projection $\underline{k}_y=\underline{k}_o\cos\phi$ along the y axis, perpendicular to the x-z plane of the window 10. The uniformity of the window 10 along the z axis insures that $\underline{k}_z$ and the projected structure of the electromagnetic field onto the z axis are conserved as the wave passes through the window. The $\underline{k}_y$ component, however, can in general be partially converted by scattering of the wave by the periodicity P of the window. Thus, two or more waves can emerge from the window, each having a different $k'_x$ component of its new wave vector $\vec{k}'_o$, $|k'_o|=|\underline{k}_o|$, and new, smaller $k'_y$. The relationship is such that $k'^2_x+k'^2_y=\underline{k}_y^2$, where $\underline{k}_y$ is the original value and $k'_z=\underline{k}_z$ (by conservation of $k_z$). The requirement $P<\lambda_o$ to avoid such scattering when $\phi=0$, can be rewritten $P<2\pi/\underline{k}_o$. This more generally becomes $P<2\pi/\underline{k}_y$, when $\phi=0$ and $\underline{k}_z$ is conserved. Since $\underline{k}_y/\underline{k}_o=\cos\phi<1$, the constraint $P<2\pi/k_y$ allows P be larger by $1/\cos\phi$ than the constraint $P<\lambda_o=2\pi/k_o$ for the same $\lambda_o$. Therefore, when scaling to a higher frequency (smaller $\lambda_o$), P can be held constant if the window is operated at angle $\phi$, thereby easing the difficulty of fabricating the coolant channels 26.

Figure 4:
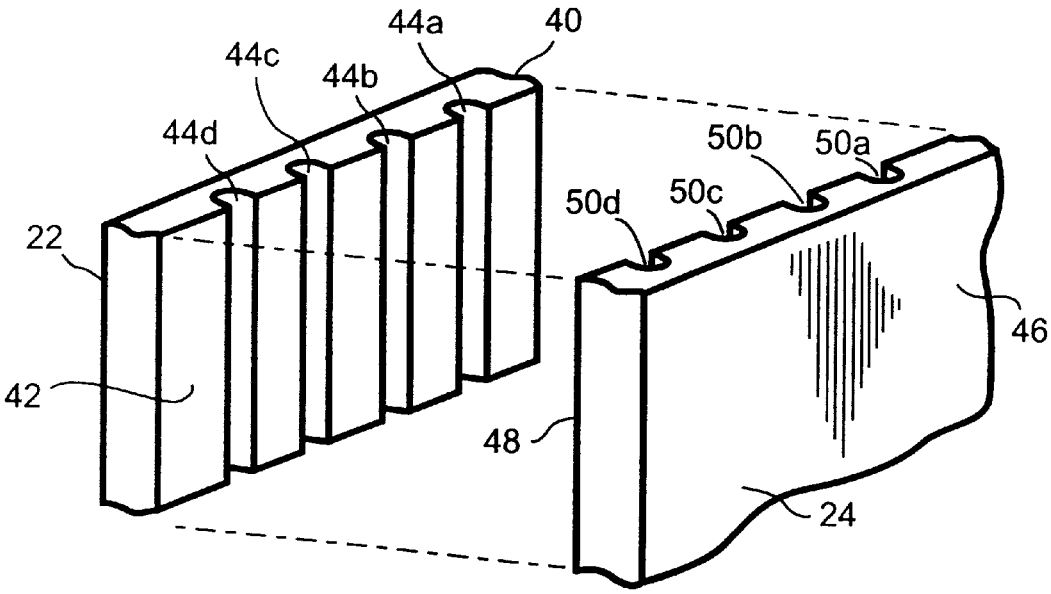
FIG. 4 is an exploded view of strata of dielectric material used in the manufacture of the microwave window of the present invention.

For the manufacture of a window 10 in accordance with the present invention, a stratum 40 of dielectric material is selected and its inner surface 42 is formed with a plurality of parallel grooves 44, of which the grooves 44 ad are representative. The stratum 40, formed with grooves 44, is shown in FIG. 4. Also shown in FIG. 4 is another stratum 46 of the same dielectric material. Similar to the stratum 40, stratum 46 has an inner surface 48 which is formed with a plurality of parallel grooves 50. As contemplated by the present invention, the grooves 44 in stratum 40 and the grooves 50 in stratum 46 can be formed by any grinding methods known in the pertinent art.

Once the strata 40 and 46 have been formed with their respective grooves 44 and 50, they are joined together substantially as indicated in FIG. 4. Specifically, respective grooves 44 in stratum 40 are positioned to overlie grooves 50 in stratum 46. The strata 40 and 46 can then be permanently joined together by any well known method, such as fusion bonding. The result of this bonding is the formation of a monolithic structure which has substantially parallel coolant channels 26 as shown in FIG. 2. Further, once the coolant channels 26 have been formed, the surface 22 of stratum 40 can be formed with the cylindrical lenses 28 and, similarly, the surface 24 of stratum 46 can be formed with the cylindrical lenses 30. Again, like for the formation of the grooves 44 and 50, the lenses 28 and 30 can be ground from the surfaces 22 and 24 by any means well known to the skilled artisan. According to the size of the strata 40 and 46, the particular dimensions chosen for the grooves 44 and 50, and the chosen curvature of the lenses 28 and 30, the particular dimensions for window 10 can be relatively easily established.

While the particular microwave window as herein shown and disclosed in detail is fully capable of obtaining the objects and providing the advantages herein before stated, it is to be understood that it is merely illustrative of the presently preferred embodiments of the invention and that no limitations are intended to the details of construction or design herein shown other than as described in the appended claims.

What is claimed is:

1. A microwave window which comprises:

a layer of dielectric material having a first surface and a second surface, said first surface being substantially parallel to said second surface and said layer being formed with a plurality of substantially parallel channels inside said layer between said first surface and said second surface for passing a coolant therethrough, each said channel defining a longitudinal axis to establish a plurality of longitudinal axes and being distanced from at least one other said channel to establish a parallel plate waveguide therebetween;

a plurality of cylindrical lenses located on said first surface to focus substantially parallel microwaves incident on each particular lens into convergence for passage through a respective said waveguide and away from said channels as said microwaves transit said layer each particular lens rising less than approximately one fourth of the free space wavelength of the incident microwaves; and a plurality of cylindrical lenses located on said second surface to refocus microwaves emerging from a respective said waveguide into a substantially parallel relationship as said microwaves radiate from said layer.

2. A microwave window as recited in claim 1 wherein said dielectric material is silicon nitride ($Si_3N_4$).

3. A microwave window as recited in claim 1 wherein said coolant is a liquid metal.

4. A microwave window as recited in claim 1 wherein each channel has a cross-section and said cross-section has a racetrack configuration with opposite substantially flat parallel sides and opposite substantially half-circle curved ends.

5. A microwave window as claim 1 wherein said lenses formed on said first surface each having a focal line located in a respective said parallel plate waveguide with said focal line being substantially equidistant from said adjacent channels.

6. A microwave window as recited in claim 1 wherein said layer has a thickness between said first surface and said second surface and said thickness is sufficient to withstand approximately ten atmospheres of differential pressure.

7. A microwave window as recited in claim 1 wherein each said channel has a center and a distance, P, between adjacent said centers is less than the free space wavelength of said microwaves ($P<\lambda_o$).

8. A microwave window as recited in claim 7 wherein said plurality of longitudinal axes define a reference plane, and further wherein a measurement plane is defined as being perpendicular to said reference plane and including one said longitudinal axis, and wherein said microwave radiation is incident on said first surface at an angle $\phi$ in said measurement plane, said angle $\phi$ being measured from a line perpendicular to said longitudinal axis in said measurement plane.

9. A microwave window which comprises:

a plurality of juxtaposed parallel plate waveguides, said waveguides being established in a layer of dielectric material having a first surface and a second surface, said first surface being substantially parallel to said second surface;

a first plurality of juxtaposed substantially cylindrical lenses positioned at said first surface for focusing parallel microwave beams incident on said lenses into convergence for transit through a respective said waveguide each particular lens rising less then approximately one fourth of the free space wavelength of the incident microwave beams; and a second plurality of juxtaposed substantially cylindrical lenses positioned at said second surface opposite said first plurality of lenses for refocussing said microwave beams after transit through said respective waveguides for radiation of said microwave beams from said window in a substantially parallel relationship.

10. A microwave window as recited in claim 9 further comprising:

a plurality of substantially parallel channels formed in said dielectric material layer between said first surface and said second surface, each channel being juxtaposed with at least one other channel and each channel having a cross-section configured as a racetrack with opposite substantially flat parallel side and opposite substantially half-circle curved ends; and a liquid metal coolant filling each channel to establish said waveguides between adjacent juxtaposed sides of said channels.

11. A microwave window as recited in claim 10 wherein said dielectric material is silicon nitride ($Si_3N_4$).

12. A microwave window as recited in claim 11 wherein each lens of said first and second plurality of lenses has a focal line located in a respective said parallel plate waveguide with said focal line being substantially equidistant from said adjacent channels.

13. A microwave window as recited in claim 12 wherein said window has a thickness between said first plurality of lenses and said second plurality of lenses and said thickness is sufficient to withstand approximately ten atmospheres of differential pressure.

14. A microwave window as recited in claim 13 wherein each channel has a center, and a distance, P, between adjacent centers is less than the free space wavelength of said microwaves ($P<\lambda_o$).

15. A microwave window as recited in claim 14 wherein each channel defines a longitudinal axis and the plurality of longitudinal axes define a reference plane, and further wherein a measurement plane is defined as being perpendicular to said reference plane and including one said longitudinal axis, and wherein said microwave beams are incident on said first surface at an angle $\phi$ in said measurement plane, said angle $\phi$ being measured from a line perpendicular to said longitudinal axis in said measurement plane.

* * * * *

UNITED STATES PATENT AND TRADEMARK OFFICE

CERTIFICATE OF CORRECTION

PATENT NO. : 5,917,389

DATED : June 29, 1999

INVENTOR(S) : Charles Porter Moeller, et al.

It is certified that error appears in the above-identified patent and that said Letters Patent is hereby corrected as shown below:

Column 7, Line 4
DELETE
[grooves 44 ad]
INSERT
--grooves 44 a-d--

Column 8, Line 8
DELETE
[window as claim 1]
INSERT
--window as recited in claim 1--

Signed and Sealed this

Thirtieth Day of November, 1999

*Attest:*

*Attesting Officer*

Q. TODD DICKINSON

*Acting Commissioner of Patents and Trademarks*